US011268745B2

(12) United States Patent
Larson et al.

(10) Patent No.: US 11,268,745 B2
(45) Date of Patent: Mar. 8, 2022

(54) HARNESS FREE ICE MAKER SYSTEM

(71) Applicant: ILLINOIS TOOL WORKS INC., Glenview, IL (US)

(72) Inventors: Eric K. Larson, Cumberland, RI (US); William D. Chatelle, Cranston, RI (US); Juan J. Barrena, Johnston, RI (US); Jason A. Dides, North Kingston, RI (US)

(73) Assignee: Illinois Tool Works Inc., Glenview, IL (US)

( * ) Notice: Subject to any disclaimer, the term of this patent is extended or adjusted under 35 U.S.C. 154(b) by 195 days.

(21) Appl. No.: 16/540,821

(22) Filed: Aug. 14, 2019

(65) Prior Publication Data

US 2020/0056825 A1 Feb. 20, 2020

Related U.S. Application Data

(60) Provisional application No. 62/719,327, filed on Aug. 17, 2018.

(51) Int. Cl.
*F25C 5/20* (2018.01)
*F25C 5/08* (2006.01)

(52) U.S. Cl.
CPC ..... *F25C 5/22* (2018.01); *F25C 5/08* (2013.01); *F25C 2500/02* (2013.01); *F25C 2600/04* (2013.01)

(58) Field of Classification Search
CPC ..... F25C 2600/04; F25C 1/10; F25C 1/25; F25C 5/22; H04B 5/0093
See application file for complete search history.

(56) References Cited

U.S. PATENT DOCUMENTS

| | | | | |
|---|---|---|---|---|
| 6,698,222 | B2 * | 3/2004 | Sanna | F25D 25/024 62/229 |
| 9,154,002 | B2 * | 10/2015 | Norconk | H02J 50/80 |
| 9,369,181 | B2 * | 6/2016 | Kai | H02J 50/12 |
| 10,126,037 | B2 | 11/2018 | Barrena et al. | |

(Continued)

FOREIGN PATENT DOCUMENTS

| | | | |
|---|---|---|---|
| DE | 102017004607 | A1 | 7/2018 |
| EP | 1760733 | A1 | 7/2007 |
| JP | 2006/336969 | A | 12/2006 |

OTHER PUBLICATIONS

Wikipedia contributors. (Feb. 26, 2021). Inductor. In Wikipedia, The Free Encyclopedia. Retrieved 19:28, Apr. 21, 2021, from https://en.wikipedia.org/w/index.php?title=Inductor&oldid=1009041931 (Year: 2021).*

(Continued)

*Primary Examiner* — Kun Kai Ma
(74) *Attorney, Agent, or Firm* — Boyle Fredrickson, S.C.

(57) ABSTRACT

An ice maker is provided that may include cooperating primary and secondary coils arranged on opposite sides of a freezer cabinet wall for wirelessly transmitting electrical power through the freezer cabinet wall to energize various ice maker components. During the wireless electrical power transmission, a data/control signal may be superimposed on the electrical power waveform to allow wireless transmission of the control signal, which can be processed by a logic circuitry for implementing component control methodologies.

18 Claims, 4 Drawing Sheets

(56) References Cited

U.S. PATENT DOCUMENTS

| | | | | |
|---|---|---|---|---|
| 2008/0072610 | A1* | 3/2008 | Venkatakrishnan | F25C 5/08 62/135 |
| 2010/0206990 | A1* | 8/2010 | Petrenko | F03D 80/40 244/134 D |
| 2012/0186288 | A1 | 7/2012 | Hapke | |
| 2013/0239594 | A1* | 9/2013 | Lin | F25C 5/08 62/73 |
| 2013/0300204 | A1* | 11/2013 | Partovi | H02J 7/00302 307/104 |
| 2016/0201965 | A1* | 7/2016 | Abeygunawardana | F25C 5/08 62/349 |
| 2017/0089629 | A1* | 3/2017 | Ji | F25C 5/08 |
| 2018/0034506 | A1* | 2/2018 | Moore | H02J 50/80 |
| 2018/0123646 | A1* | 5/2018 | Onishi | H02J 7/025 |
| 2018/0245833 | A1* | 8/2018 | Brewer | F25C 5/187 |
| 2019/0041112 | A1 | 2/2019 | Chatelle et al. | |
| 2019/0063811 | A1* | 2/2019 | Tanimura | F25C 1/04 |

OTHER PUBLICATIONS

International Preliminary Report on Patentability and Written Opinion for Application No. PCT/US2019/046617, International filing date Aug. 15, 2019, dated Feb. 23, 2021, 6 pages.
International Search Report for Application PCT/US2019/046617 dated Nov. 19, 2019.

* cited by examiner

HARNESS FREE ICE MAKER SYSTEM

CROSS-REFERENCE TO RELATED APPLICATIONS

This application claims the benefit of U.S. provisional application 62/719,327 filed Aug. 17, 2018 and is hereby incorporated by reference.

FIELD OF THE INVENTION

The present invention relates to ice-making machines for home refrigerators and the like and specifically an ice maker eliminating the need for a wiring harness piercing the insulated wall of the freezer.

BACKGROUND OF THE INVENTION

Household refrigerators commonly include automatic ice makers located in the freezer compartment.

A typical ice maker provides an ice cube tray positioned to receive water from an electrically controlled valve that may open for a predetermined time to fill the tray. The water is allowed to cool until ice formation is ensured. At this point, the ice is harvested from the tray into an ice bin positioned beneath the ice-tray, for example by a twisting and inverting of the tray, heating of the tray, or a comb that pushes the ice cubes out of the tray. The amount of ice in the ice bin may be determined with a bail arm which periodically lowers into the ice bin to check the ice level. If the bail is blocked in its descent by a high level of ice, this blockage is detected and ice production is stopped.

Electrical power to operate an ice maker motor, included in the ice maker for inverting and twisting the ice tray or rotating the ice removing comb, and/or for electrical power for operating a resistance heater, is normally provided by a wire harness passing through a wall of the freezer compartment, for example, to deliver line voltage of about 120 volts AC to the ice maker in the freezer compartment. During manufacture, one end of the harness may be fished through an opening in the freezer wall and then attached by a releasable connector system to the ice maker. The connector must be shielded from possible water spill and contact with the consumer and so often includes a separate shroud fitting over the two connector halves. The hole in the freezer wall through which the harness passes must be large enough for the connector but then must be sealed, for example, with the gasket and adhesive to prevent moisture ingress and escape of refrigerated air.

SUMMARY OF THE INVENTION

The present inventors have recognized that the power required by an ice maker can be delivered by magnetic power transferred from a primary coil outside of the freezer compartment which communicates with a corresponding secondary coil sealed safely within the housing without breaching the refrigerator wall. In this way, the energy needed for ejecting the ice cubes and optionally heating the ice mold to release the ice cubes can be obtained without a costly and unwieldy harness and its associated manufacturing steps. Further, eliminating the harness connector reduces potential exposure of the consumer to electrical power conducted through spilled liquid or accidental disconnection of the connector.

Specifically then, the present invention provides an ice making apparatus having a housing with a sidewall adapted to be positioned adjacent to a freezer cabinet wall. An electric motor positioned within the housing communicates through a rotatable shaft exposed through a front wall of the housing. An ice mold is positionable adjacent to the housing and provides multiple pockets for molding water into ice cubes. Logic circuitry controls the entire ice making process from the filling of the ice mold with water to the ejection of the cubes once frozen. It does this by controlling the electric motor and rotatable shaft and water valve and through an algorithm that uses time and ice mold temperature. A secondary coil is supported by the housing on the sidewall to receive electrical energy from an oscillating magnetic field passing through the freezer cabinet wall, and a rectifier circuit converts the received electrical energy to a voltage supplying the logic circuitry and electric motor.

It is thus a feature of at least one embodiment of the invention to greatly simplify the installation of an ice maker while boosting electrical safety and reducing assembly time.

The logic circuitry may further connect to the secondary coil for the communication of control signals via the secondary coil for the control of a sequencing of ice making steps using the ice-maker.

It is thus a feature of at least one embodiment of the invention to eliminate not only power supply lines but also valve control lines that would ordinarily need to pass back into the freezer compartment wall to control a valve outside of the freezer compartment protected from freezing. It is another feature of at least one embodiment of the invention to use the same inductive coupling pathway for both power and data communication.

The logic circuitry may determine a fill time for the ice mold and communicate with the secondary coil to wirelessly transmit a valve control signal receivable by a primary coil positioned behind the freezer cabinet wall to control a water valve.

It is thus a feature of at least one embodiment of the invention to provide for ice-maker control at fill time, for example, useful when fill level sensing is adopted.

The electrical energy received by the secondary coil may be received at a first frequency range having a fundamental frequency at least 10 times lower than the second frequency range of transmission of the control signal.

It is thus a feature of at least one embodiment of the invention to provide different frequency domains of data and power allowing them to be simultaneously transmitted in opposite directions.

The ice making apparatus may include a high-pass filter for isolating the received electrical energy from the control signal.

It is thus a feature of at least one embodiment of the invention to provide a simple circuit for extracting data communication.

The control signal may be digitally encoded.

It is thus a feature of at least one embodiment of the invention to provide a robust communication resistant to electrical interference that may occur on the wireless power channel from power transmission and load fluctuations, for example, from the electric motor.

The housing may be a polymer material and the coil may be sealed within the housing.

It is thus a feature of at least one embodiment of the invention to isolate electrical conductors from the freezer compartment by the robust encapsulation of the housing as opposed to a flexible, removable harness sheath.

The secondary coil may provide multiple turns of wire wrapped around an axis perpendicular to the freezer cabinet wall when the housing is mounted to the freezer cabinet wall.

It is thus a feature of at least one embodiment of the invention to maximize power transmission through the freezer compartment wall by optimized orientation and construction of the secondary coil.

The ice making apparatus may include fasteners positioned on the sidewall and separated along a plane of the sidewall to support the housing by the freezer cabinet wall.

It is thus a feature of at least one embodiment of the invention to provide a simple mechanical connection of the ice maker to a sidewall that simultaneously operates to connect electrical power to the ice maker.

The ice mold may further include a heater element, and the voltage supplying the logic circuitry and electrical motor may also supply the heater element as controlled by the logic circuitry.

It is thus a feature of at least one embodiment of the invention to reduce peak power demands by providing a nonmechanical ice ejection mechanism readily accommodated by power from the inductive coupling through the secondary coil.

The ice making apparatus may further include a primary coil supported by the freezer cabinet wall and providing an oscillating electromagnetic field for receipt by the secondary coil when the housing is attached to the freezer cabinet wall. The primary coil may be attached to a driver circuit controlling power to the primary coil according to a load placed on the primary coil by the secondary coil.

It is thus a feature of at least one embodiment of the invention to provide improved energy efficiency for inductive coupling, such as reducing coil heating and the like, by intelligently controlling power transmission according to a demand by the ice maker.

The oscillating electromagnetic field may be a narrowband signal.

It is thus a feature of at least one embodiment of the invention to minimize resistive heating of the coils while maximizing power transmission.

The ice making apparatus may further include a water valve positioned outside of the freezer cabinet, and the primary coil is controlled by a driver circuit that decodes a digital signal from the secondary coil to activate a water valve.

It is thus a feature of at least one embodiment of the invention to provide a decoding of a water valve control signal through the same coil that provides power to the ice maker.

Other features and advantages of the invention will become apparent to those skilled in the art upon review of the following detailed description, claims and drawings in which like numerals are used to designate like features.

Figure 1:
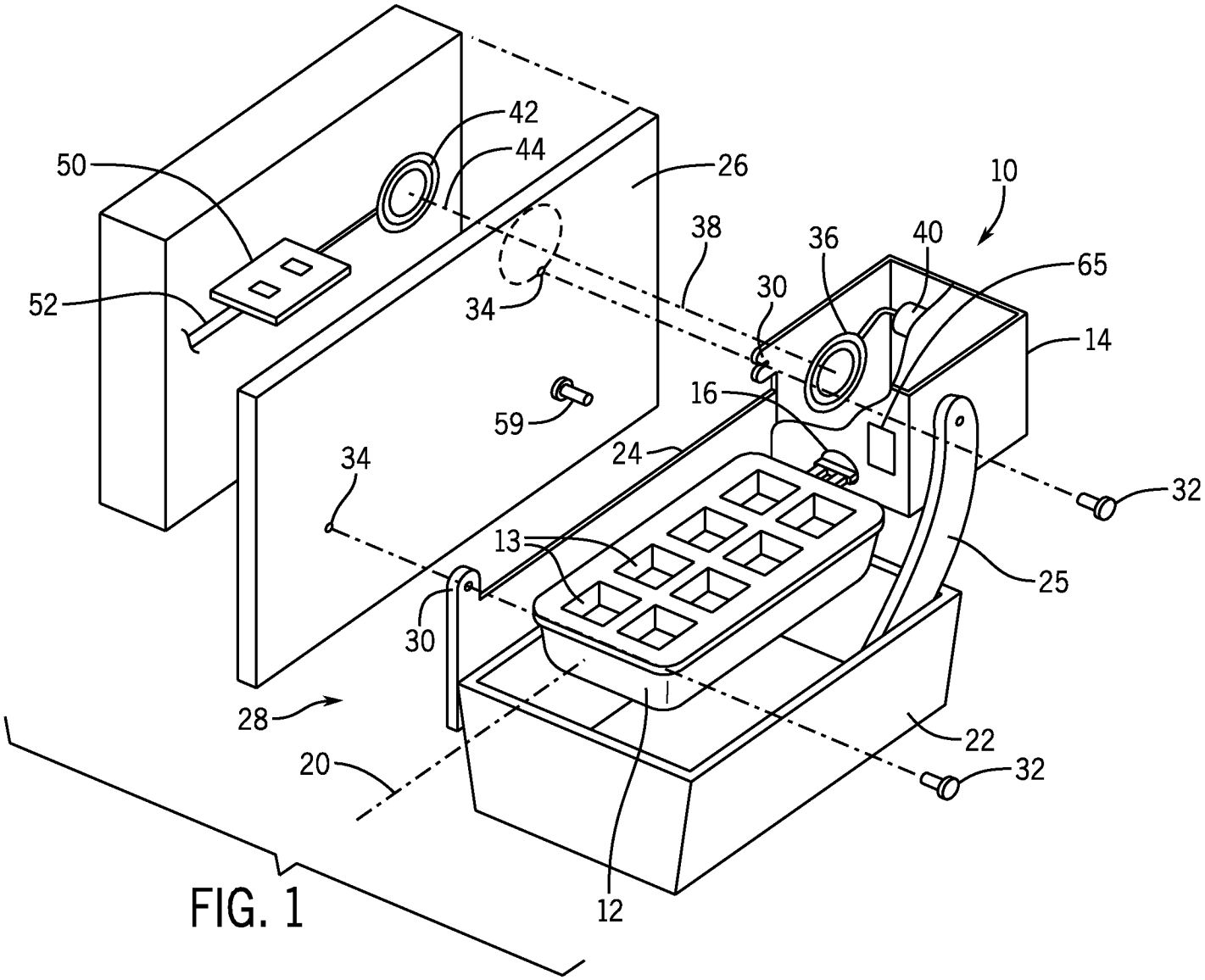
FIG. 1 is an exploded perspective view of an ice making machine providing an ice tray rotatable by a motor unit for discharging ice cubes into a receiving bin and showing positioning of a primary coil outside of the freezer compartment wall communicating with a secondary coil inside the motor unit housing.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an ice maker 10 may include an ice mold 12 having multiple pockets 13 for receiving water and molding it into frozen ice cubes (not shown) of arbitrary shape. The ice mold 12 may be positioned adjacent to a drive housing 14 exposing one end of a rotatable shaft 16 connected to the ice mold 12. The other end of the rotatable shaft 16 within the drive housing 14 communicates with an electric motor (not shown in FIG. 1) within the drive housing 14 for rotating the ice mold 12 between a first position (as shown in FIG. 1) allowing the ice mold 12 to be filled with water and a second position (not shown) rotated 180 degrees about a rotation axis 20 of the shaft 16 so that the ice mold 12 is inverted to discharge ice cubes into a lower collection bin 22. The motor may be a DC permanent magnet motor, a stepper motor, or other electrical motor well known in the art.

A mechanism within the drive housing 14 operates a bail arm 25 that may descend into the lower collection bin 22 to check for ice level according to methods well known in the art, for example, as described in U.S. patent application Ser. No. 13/288,443, entitled "Ice-Harvest Drive Mechanism with Dual Position Bail Arm," which is assigned to the assignee of the present application and hereby incorporated by reference in its entirety.

The drive housing 14 has a sidewall 24 that may attach to a corresponding freezer cabinet sidewall 26 extending generally vertically to a side of the freezer compartment 28 of the standard refrigerator. The sidewall 26 may include mounting points 30 receiving threaded fasteners 32 passing through the mounting points 33 to be received by aligned holes 34 in the sidewall 26 so that the threaded fasteners 32 may fix the sidewall 24 closely proximate to the sidewall 26. It will be appreciated that a variety of other attachment mechanisms may be used in this capacity including but not limited to rivets, plastic barbed fasteners, adhesives, and the like.

The drive housing 14 as so attached positions a secondary coil 36 held within a volume of the housing 14 closely adjacent to the sidewall 26 and with a winding axis 38 substantially perpendicular to contacting broad faces of the sidewalls 24 and 26. The winding axis 38 describes an axis about which multiple turns of copper conductor are wound in a loop to make the secondary coil 36. Generally, the secondary coil 36 communicates with a power processing module that has a power processing circuit 40 also positioned within the housing 14 as will be discussed below.

A primary coil 42 may be positioned outside of the sidewall 26 with respect to the freezer compartment 28 and may have an axis 44 about which multiple turns of copper conductor (preferably Litz wire) are wound to form the primary coil 42. This axis 44 is also generally perpendicular to the broad contacting faces of sidewall 26 and sidewall 24 and is aligned with axis 38. Generally, both the secondary coil 36 and primary coil 42 will be of comparable area with a diameter larger than one inch. In one embodiment, each of the secondary coil 36 and primary coil 42 may be attached by adhesive or the like to the corresponding sidewalls 24 and 26 and will be encapsulated or covered against direct contact with liquid or materials within the freezer compartment. The secondary coil 36 and primary coil 42 may be separated by a relatively short distance (for example, by as much as one-half inch) but are desirably as close as possible while allowing for the desired electrical isolation provided by the sidewall 26 and sidewall 24.

The primary coil 42 communicates with power processing circuitry 50 that may receive line power through conductors 52 at approximately 120 volts AC or alternatively from an internal 24-volt AC power supply available in the refrigerator. Generally, the primary coil 42 is completely isolated from the freezer compartment 28 and the secondary coil 36 is isolated from the freezer compartment 28 by insulating material of the sidewall 26 and otherwise protected and covered by the housing 14.

A water supply line 59 may also pass through the sidewall 26 and is received by internal channels of the housing 48 and delivered to a water delivery nozzle 65 for filling the ice mold 12 when the ice mold 12 is in the first position (or the upright "filling" position) as depicted in FIG. 1.

Figure 2:
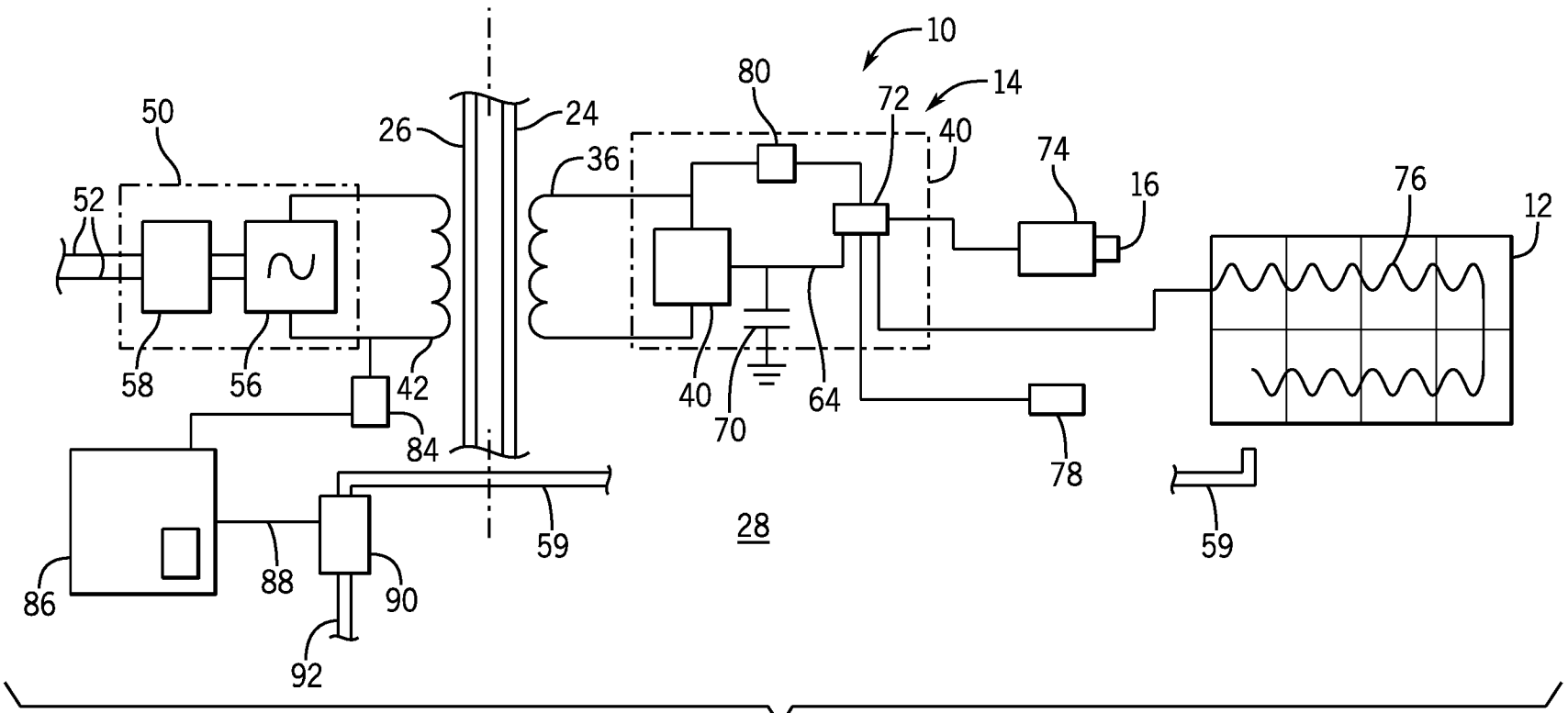
FIG. 2 is schematic diagram of the principal components of the wireless power transfer system provided by the primary coil and secondary coil of FIG. 1.

Referring now also to FIG. 2, generally the primary coil 42 will be driven by a high-power sine wave oscillator 56 being part of power processing circuitry 50 producing a narrow bandwidth AC power waveform 43 (shown in FIG. 3), for example, using a tuned or resonant circuit to concentrate energy in a single narrow frequency band. In one embodiment, the oscillation frequency will be substantially above that of line current (i.e., 60 Hz) or rectified line current (e.g., 120 Hz) and may be, for example, 350 to 700 kHz to provide for more efficient transmission. Such higher frequencies also permit filtering with smaller capacitors as will be discussed with respect element 70.

The sine wave oscillator 56 is controlled by a load sensing circuit 58 sensing a load on the primary coil 42 representing power being consumed by the ice maker 10. The load sensing circuit 58 operates to reduce the drive current to the primary coil 42 during times of low load or power consumption by the ice maker 10 to reduce resistive losses, to reduce heating of primary coil 42, and to reduce heating of the corresponding secondary coil 36. This sensing can be accomplished by, for example, monitoring current flow through the primary coil 42 so that voltage on the primary coil 42 is reduced during times of low current draw, and voltage on the primary coil 42 is increased during times of high current draw. The load sensing circuit 58 may also adjust a frequency of operation of the sine wave oscillator 56 to provide a self-tuning of the frequency of the sine wave oscillator 56 to equal a natural resonant frequency of resonant circuits associated with each of the primary coil 42 and secondary coil 36. The self-tuning may be performed by, for example, introducing slight perturbations in frequency of the sine wave oscillator 56 by the load sensing circuit 58 to sense a peak current delivery such as corresponds to a frequency of most efficient energy transfer. This frequency of peak current delivery is then used at the center point of the perturbations in frequency. This introduction of perturbations may be periodically activated and deactivated reflecting an expected slow variation in the center point.

Figure 3:
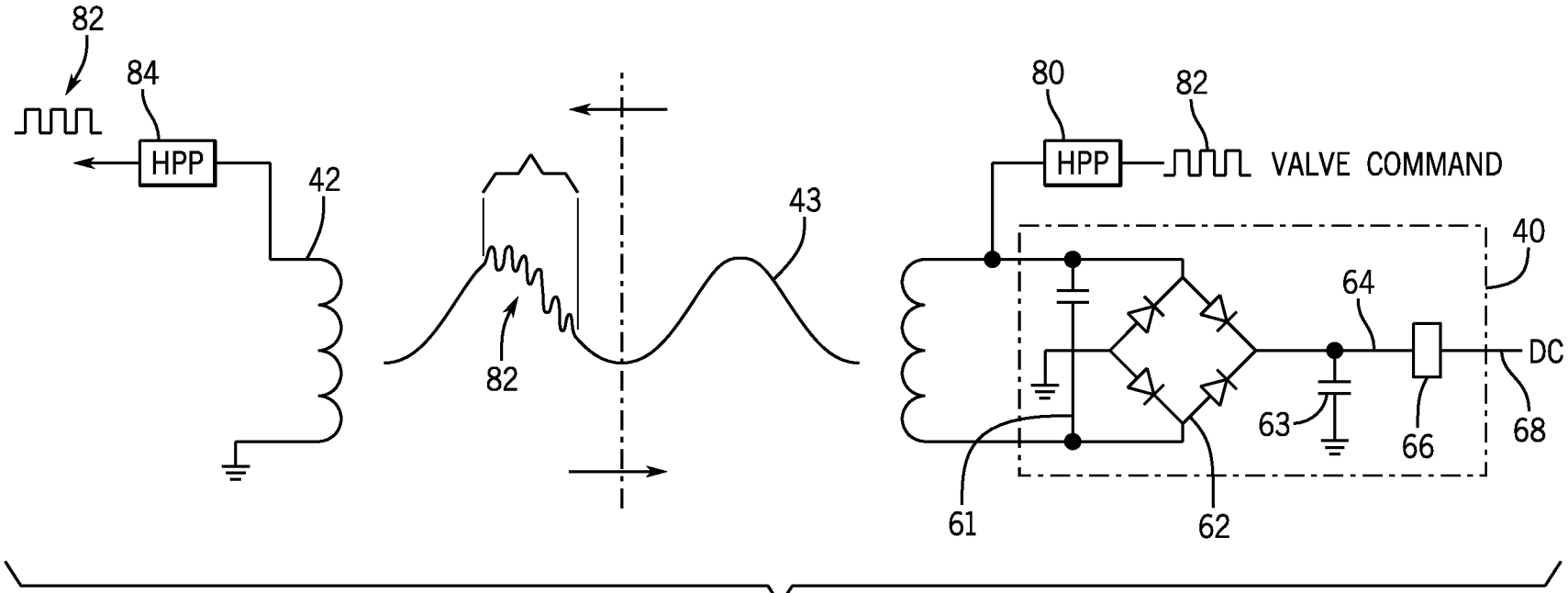
FIG. 3 is a simplified diagram of the primary coil and secondary coil of FIG. 1 showing a composite signal produced for data and power communication.

Referring now also to FIG. 3, the secondary coil 36 may attach to the power processing circuit 40 which may also include components 61 providing the resonant circuit with the inductance of the secondary coil 36. Power processing circuit 40 may further include a full wave rectifier 62 and filter capacitor 63 for converting the AC signal received from the secondary coil 36 into an unregulated DC voltage 64. This unregulated DC voltage may then be received by a boost or buck converter 66 of a type known in the art that may provide a regulated voltage or current 68 to the remaining circuitry of the ice maker 10. A capacitor or battery 70 may provide for energy storage allowing a relatively low continuous transfer of energy between the primary coil 42 and secondary coil 36 that is nevertheless sufficient to handle momentary peak demand by the other circuitry of the ice maker 10. When a capacitor 70 is employed, an operation of the sine wave oscillator 56 at higher frequencies of may permit smaller capacitor values because of the shorter energy storage duration required between positive and negative going AC cycles at higher frequencies.

Power from the power processing circuit 40 may be provided to a microcontroller 72 controlling other operations of the ice maker 10 including delivering power to a motor 74 attached to the shaft 16, a heater 76 running through the ice mold 12 to release the ice cubes there from, and one or more sensors 78 of types including, for example, a bail arm sensor, a thermal sensor for measuring ice temperature, a fill sensor for measuring water level, and/or an ice mold orientation signal of the type generally known in the art.

Referring still to FIGS. 2 and 3, the microcontroller 72 may also communicate through a high-pass filter 80 with the secondary coil 36 to transmit a digital signal 82 through the high-pass signal to be superimposed on the AC power waveform 43. Digital signal 82 provides a corresponding magnetic flux signal that passes through the sidewalls 24 and 26 is received by the primary coil 42 where a similar high-pass filter 84 allows extraction of the digital signal 82 free from the AC power waveform 43.

Digital signal 82 may be received by a refrigerator controller 86 and may be digitally encoded, for example, with start and stop bits for a particular digital code to allow digital signal 82 to be distinguished from noise. When the digital signal 82 is detected by the microcontroller 72, the microcontroller 72 may provide a valve actuation signal 88 operating the electromagnetic valve 92 outside of the freezer compartment 28 to allow water to flow into the water line 59 to pass through the water line 59 to nozzle 65 for filling the ice mold 12. In this way, the valve 90 may be safely installed outside of the freezer compartment 28 (where valve 90 would be subject to freezing) and yet controlled by the ice maker 10. Generally, the refrigerator controller 86 handles other control aspects of the refrigerator including controlling a compressor according to various temperature sensors, implementing defrost cycles, etc. as is generally understood in the art of refrigerator manufacture.

Figure 4:
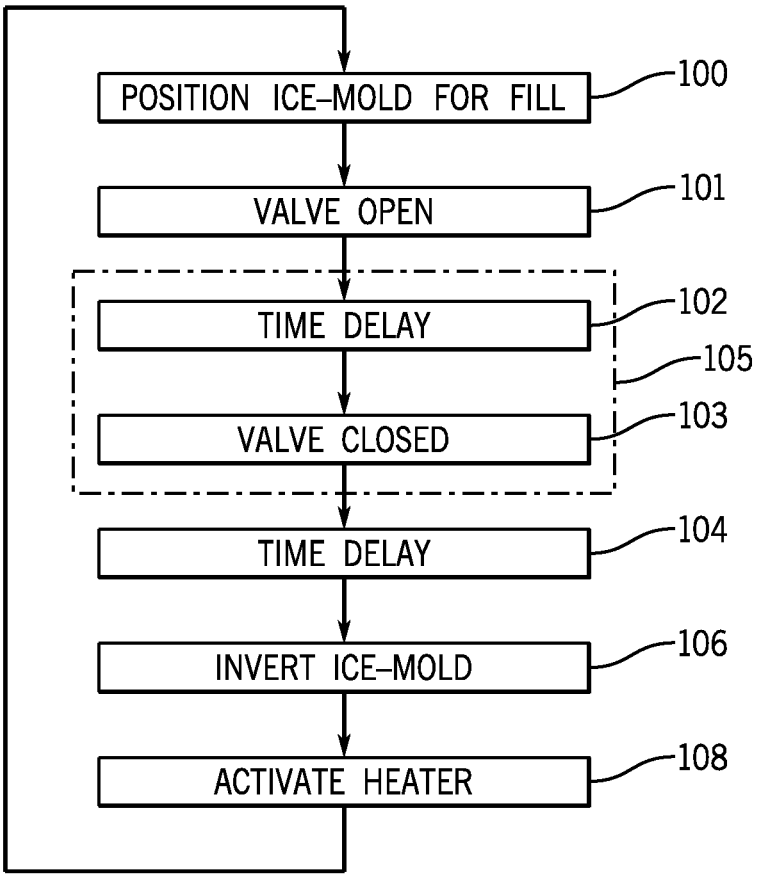
FIG. 4 is a flowchart of a program executed by the controller circuit of the ice maker.

Referring now to FIGS. 2 and 4, the microcontroller 72 will generally operate according to internal firmware or the like to place the ice mold 12 in a first upright "filling" position as shown in FIG. 1, per process block 100. This position may be detected, for example, by sensors 78 indicating a position of the ice mold 12. Once the ice mold 12 is in this upward position, the microcontroller 72 may generate digital signal 82, which activates the water valve 90 (as shown in FIG. 2)

The duration of the operation of the water valve 90 is controlled to fill but not overfill the ice mold 12. This may be accomplished in one of several ways. In a first embodiment, the microcontroller 72 may send a valve open signal as indicated by process block 101 and then may implement a time delay as indicated by process block 102 sufficient to allow filling but not overfilling of the ice mold. This time delay may be for a predetermined time or may be controlled by a water level sensing system, for example, as described in U.S. patent application Ser. No. 16/068,400 entitled: "Smart Ice Machine" which is assigned to the assignee of the present invention and hereby incorporated by reference in its entirety. In this latter example, the program will loop during the time delay block 102 until proper water level is sensed. At that time, as indicated by process block 103, a second digital signal 62 is sent deactivating the water valve 90.

Alternatively, process blocks 102 and 103 may be implemented by the refrigerator controller 86 that communicates directly with the water valve 90. The refrigerator controller 86 may hold a predetermined fill time and automatically shut the water valve 90 off after that time or may receive a water level sensor signal from the microcontroller 72 operating de facto as a valve closed signal.

After filling of the ice mold 12, the microcontroller 72 then enters a time delay period indicated by process block 104 to permit freezing of the water in the ice mold 12. This time delay may be according to a predetermined elapsed time or a measuring of a temperature of water through a sensor 78. At the conclusion of the timing period of process block 104, as indicated by process block 106, the microcontroller 72 operates the motor 74 to invert the ice mold 12 over the bin 22 into the second position (or the inverted "ejecting" position). Microcontroller 72 then activates the heater 76 as indicated by process block 108.

While the depicted embodiment shows shaft 16 used for rotating the ice mold 12, it will be appreciated that the present invention is equally applicable to those systems where the shaft 16 operates a comb to remove cubes from a stationary ice mold 12.

The present application hereby incorporates the following applications assigned to the assignee of the present invention and hereby incorporated in their entirety by reference: U.S. patent application Ser. No. 13/288,443 entitled: "Ice-Harvest Drive Mechanism With Dual Position Bail Arm"; U.S. patent application Ser. No. 15/756,382 entitled: "Ice-Maker With Weight-Sensitive Ice Bin"; U.S. patent application Ser. No. 16/075,181 entitled: "Flexing Tray Ice-Maker with AC Drive"; and U.S. patent application Ser. No. 14/438,231 entitled: "Ice-Maker Motor With Integrated Encoder and Header."

The term "narrow bandwidth" refers to a signal that is approximately sinusoidal having a fundamental total harmonic distortion of less than 30 percent. It will be generally recognized that the process steps of FIG. 4 may be flexibly allocated between the refrigerator controller 86 and the microcontroller 72. For example, the refrigerator controller 86 may provide for the overall cycle timing communicating command steps to the microcontroller 72 which provides no independent timing, or, conversely, the microcontroller 72 may provide for all of the timing steps and the refrigerator controller 86 may simply respond to commands, for example, for control of valve 90, or any variation in between these two examples.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a microprocessor" and "a processor" or "the microprocessor" and "the processor," can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. An ice making apparatus comprising:

a housing having a sidewall adapted to be positioned adjacent to a freezer cabinet wall of a freezer cabinet, wherein:

the freezer cabinet wall defines an inner cabinet wall surface that faces toward an interior of the freezer cabinet and an outer cabinet wall surface that faces away from the interior of the freezer cabinet; and the housing sidewall defines an inner housing sidewall surface that faces toward the interior of the freezer cabinet and an outer housing sidewall surface that faces away from the interior of the freezer cabinet;

an electric motor positioned within the housing and communicating through a rotatable shaft exposed through a front wall of the housing;

an ice mold positionable adjacent to the housing and providing multiple pockets for molding water into ice cubes;

logic circuitry for controlling the electric motor and rotatable shaft to eject ice cubes from the ice mold after the ice mold has received water and allowed that water to freeze;

a primary coil supported by the freezer cabinet wall at the outer cabinet wall surface and configured to provide an oscillating magnetic field passing through the freezer cabinet wall;

a secondary coil positionally fixed with respect to the primary coil and supported by the housing sidewall at the inner housing sidewall surface to receive electrical energy from the oscillating magnetic field passing through the freezer cabinet wall and the housing sidewall; and a rectifier circuit for converting the received electrical energy to a voltage supplying the logic circuitry and electric motor.

2. The ice making apparatus of claim 1 wherein the logic circuitry further connects to the secondary coil for the communication of control signals via the secondary coil for the control of a sequencing of ice making steps using the icemaker.

3. The ice making apparatus of claim 2 wherein the logic circuitry communicates with at least one sensor for determining a fill time for the ice mold and communicates with the secondary coil to wirelessly transmit a start signal receivable by the primary coil positioned behind the freezer cabinet wall to activate a water valve.

4. The ice making apparatus of claim 2 wherein the electrical energy received by the secondary coil may be received at a first frequency range having a fundamental frequency of at least 10 times lower than the second frequency range of transmission of the control signal.

5. The ice making apparatus of claim 4 further including a high-pass filter for isolating the received electrical energy from the control signal.

6. The ice making apparatus of claim 5 wherein the control signal is digitally encoded.

7. The ice making apparatus of claim 1 wherein the housing is a polymer material and the coil is sealed within the housing.

8. The ice making apparatus of claim 1 wherein the secondary coil provides multiple turns of wire wrapped around an axis perpendicular to a broad face of the freezer cabinet wall when the housing is mounted to the freezer cabinet wall.

9. The ice making apparatus of claim 8 further including fasteners positioned on the sidewall and separated along a plane of the sidewall to support the housing by the freezer cabinet wall.

10. The ice making apparatus of claim 1 wherein the ice mold further includes a heater element and wherein the voltage supplying the logic circuitry and electrical motor also supplies the heater element as controlled by the logic circuitry.

11. The ice making apparatus of claim 10 wherein the logic circuitry controls electrical power to the motor to alternately position the ice mold in a first freezing position with the pockets opening upward for receiving water therein and in a second ejection position with the pockets opening downward after a time required to freeze the water in the pockets and wherein a timing circuit further controls the heater element to activate the heater element when the ice mold is in the second ejection position.

12. The ice making apparatus of claim 1 wherein the primary coil and the secondary coil are mounted in alignment with each other along an axis that is perpendicular to the rotatable shaft exposed through the front wall of the housing.

13. The ice making apparatus of claim 12 wherein the primary coil provides multiple turns of wire wrapped around an axis perpendicular to the freezer cabinet wall when the housing is mounted to the freezer cabinet wall.

14. The ice making apparatus of claim 12 wherein a winding axis of the primary coil is axially aligned with a winding axis of the secondary coil when the housing is mounted to the freezer cabinet wall.

15. The ice making apparatus of claim 12 wherein the primary coil is attached to a driver circuit controlling power to the primary coil according to a load placed on the primary coil by the secondary coil.

16. The ice making apparatus of claim 15 wherein the oscillating magnetic field is a narrow bandwidth signal.

17. The ice making apparatus of claim 12 further including a water valve positioned outside of the freezer cabinet and wherein the primary coil is controlled by a driver circuit that decodes a digital signal from the secondary coil to activate the water valve.

18. The ice making apparatus of claim 12 further including a freezer cabinet wall wherein the primary coil is mounted on an outside of the freezer cabinet wall to be electrically isolated from contents in the freezer cabinet.

* * * * *